US007911395B2

(12) United States Patent
Nevo et al.

(10) Patent No.: US 7,911,395 B2
(45) Date of Patent: Mar. 22, 2011

(54) OPTICALLY DRIVEN ANTENNA

(75) Inventors: Doron Nevo, Ra'anana (IL); Moshe Oron, Rehovot (IL); Ram Oron, Nes Ziona (IL); Boaz Nemet, Tel-Aviv (IL)

(73) Assignee: Kilolambda Technologies, Ltd., Tel Aviv (IL)

( * ) Notice: Subject to any disclaimer, the term of this patent is extended or adjusted under 35 U.S.C. 154(b) by 332 days.

(21) Appl. No.: 12/302,448

(22) PCT Filed: May 29, 2007

(86) PCT No.: PCT/IL2007/000643

§ 371 (c)(1),
(2), (4) Date: Nov. 25, 2008

(87) PCT Pub. No.: WO2007/138583

PCT Pub. Date: Dec. 6, 2007

(65) Prior Publication Data

US 2009/0073053 A1 Mar. 19, 2009

(30) Foreign Application Priority Data

May 30, 2006 (IL) ..... 176000

(51) Int. Cl.
*H01Q 15/00* (2006.01)
*H01Q 19/10* (2006.01)

(52) U.S. Cl. ..... 343/701; 343/832

(58) Field of Classification Search ..... 343/701, 343/703, 754, 755, 832, 834
See application file for complete search history.

(56) References Cited

U.S. PATENT DOCUMENTS

| | | | | |
|---|---|---|---|---|
| 5,084,707 | A * | 1/1992 | Reits | 342/376 |
| 6,177,909 | B1 | 1/2001 | Reid et al. | |
| 2003/0160724 | A1 | 8/2003 | Alexeff et al. | |

FOREIGN PATENT DOCUMENTS

| | | | |
|---|---|---|---|
| DE | 3920110 | A1 | 2/1991 |
| EP | 0 442 562 | A1 | 8/1991 |
| EP | 0 524 878 | A1 | 1/1993 |

OTHER PUBLICATIONS

International Search Report for PCT/IL2007/000643, Sep. 27, 2007.

* cited by examiner

*Primary Examiner* — Michael C Wimer
(74) *Attorney, Agent, or Firm* — Schnader Harrison Segal & Lewis LLP

(57) ABSTRACT

There is provided an optically driven, transmitting and receiving antenna transformable into an electrically invisible antenna when inactive, including a light source, a semiconductor wafer illuminatable by the light source and a microwave source or sensor. The wafer has a surface for forming optically induced plasma or electron hole concentration, assuming a spatial and temporal pattern defined by a light beam impinging thereon. Upon the wafer being exposed to the light beam having a power level sufficient for creating a dense plasma or electron hole concentration in the wafer, the wafer becomes reflective to microwaves, and returns to transparency when light from the light source is turned off.

6 Claims, 3 Drawing Sheets

OPTICALLY DRIVEN ANTENNA

FIELD OF THE INVENTION

The present invention relates to an optically driven plasma, or electron hole concentration, antenna that can be "turned off" when inactive, to render it electrically invisible for reducing scattering or reflecting signature and eliminating coupling and interference with other nearby antennas. The antenna can be reconfigured by geometrically changing the pattern of illumination.

BACKGROUND OF THE INVENTION

The term plasma antenna has been applied to a wide variety of antenna applications that incorporate the use of an ionized medium. In the vast majority of approaches, the plasma, or ionized volume, simply replaces a solid conductor. A highly ionized plasma is essentially a good conductor, and therefore plasmas can serve as transmission line elements for guiding waves, or antenna surfaces for radiation. The concept is not new. A patent entitled "Aerial Conductor for Wireless Signaling and Other Purposes" was already granted to J. Hettinger in 1919 (U.S. Pat. No. 1,309,031). A more recent prior art is disclosed in the U.S. Pat. No. 6,621,459 B2, "Plasma Controlled Antenna", by Webb et al, describing a plasma controlled millimeter wave or microwave antenna where a plasma of electrons and holes is photo-injected into a photoconducting wafer, having a reflecting surface behind the wafer allowing the antenna to be generated at low light intensities and a 180 degree phase shift (modulo 360 degrees). This patent describes a way to reconfigure the antenna but it remains electrically visible due to the constant presence of the conducting reflector in the beam path. Another approach is described in the U.S. Pat. No. 5,982,334, "Antenna with Plasma Grating", by Manasson et al. Nov. 9, 1999, where scanning antennas with plasma gratings is described. The latter includes a semiconductor slab and an electrode set or an illuminating system for injecting plasma grating, enabling beam steering. This system is not electrically invisible when not operating, and is confined to one dimension in steering.

There is therefore a need for an optically driven, reconfigurable, plasma antenna that can be "turned off" when inactive, to render it electrically invisible for the purpose of reducing its scattering or reflecting signature and eliminating its coupling and interference with other nearby antennas.

SUMMARY OF THE INVENTION

It is therefore a broad object of the present invention to provide a geometrically reconfigurable, optically driven, transmitting and receiving plasma antenna that can be "turned off" when inactive, to render it electrically invisible for the purpose of reducing its scattering or reflecting signature and eliminating its coupling and interference with other nearby antennas.

It is a further object of the present invention to provide a laser or light emitting diode-fed semiconductor antenna, where the laser or light emitting diode light impinges on a passive semiconductor wafer, serving as a microwave reflector.

It is still a further object of the present invention to provide a laser or light emitting diode fed semiconductor antenna, where the laser or light emitting diode light impinges on a passive semiconductor wafer, made of e.g. doped Silicon, Germanium or Gallium Arsenide, serving as a microwave reflector.

It is yet a further object of the present invention to provide a laser or light emitting diode fed semiconductor antenna, where the laser or light emitting diode light impinges on a passive semiconductor wafer, serving as a microwave reflector, where the spatial geometrical shape of the impinging light defines the plasma generating area and the reflector shape.

It is a further object of the present invention to provide a laser or light emitting diode fed semiconductor antenna, where the passive semiconductor wafer, serving as a microwave reflector, is constituted by a flat, curved or multi facet surface.

It is a further object of the present invention to provide a laser or light emitting diode fed semiconductor antenna, or microwave mirror, where the laser or diode light impinges on a passive semiconductor wafer, serving as a microwave reflector, where the timing of the impinging light defines the plasma generating time and the reflector on-off time.

It is still a further object of the present invention to provide a laser or light emitting diode-fed semiconductor antenna, where the laser or light emitting diode light impinges on a passive semiconductor wafer, serving as a microwave reflector, where the spatial pattern of the impinging light is defined by a spatial filter, between the light source and the semiconductor wafer.

It is yet a further object of the present invention to provide a laser or light emitting diode-fed semiconductor antenna, where the laser or light emitting diode light impinges on a passive semiconductor wafer, where the light source, light spatial filter and microwave source are confined in a microwave absorbing enclosure, thus not being electrically detectible by a microwave probe beam.

In accordance with the present invention there is therefore provided an optically driven, transmitting and receiving antenna transformable into an electrically invisible antenna when inactive, comprising a light source, at least one semiconductor wafer illuminatable by said light source, a microwave source or sensor, said wafer having a surface for forming optically induced plasma, or electron hole concentration, assuming a spatial and temporal shape defined by a light beam impinging on it, wherein, upon said wafer being exposed to the microwave beam having a power level sufficient for creating a dense plasma in said wafer, said wafer becomes reflective to microwaves, and returns to transparency when light from said light source is turned off.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic, cross-sectional view of a geometrically reconfigurable, optically driven, plasma-transmitting antenna that can be turned off when inactive;

FIG. 2 is a schematic, cross-sectional view of a geometrically reconfigurable, optically driven, plasma-receiving antenna that can be turned off when inactive;

Figure 1:
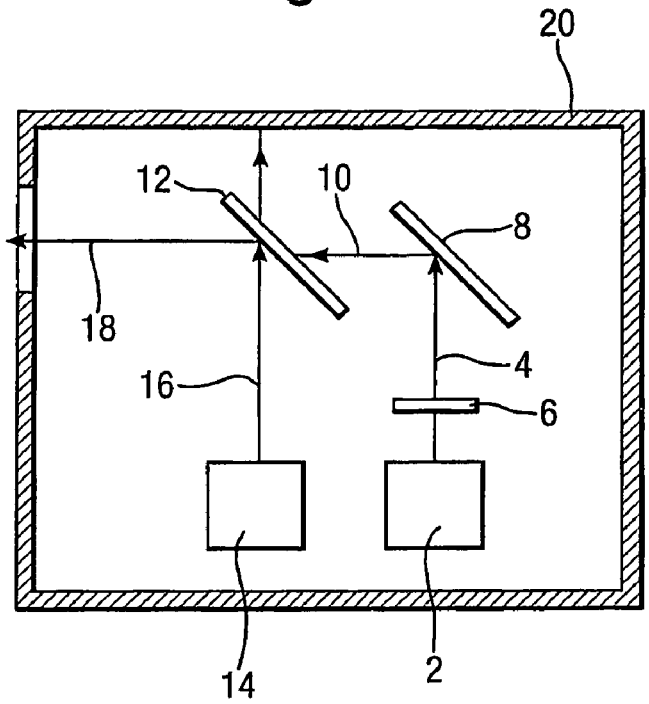
Figure 2:
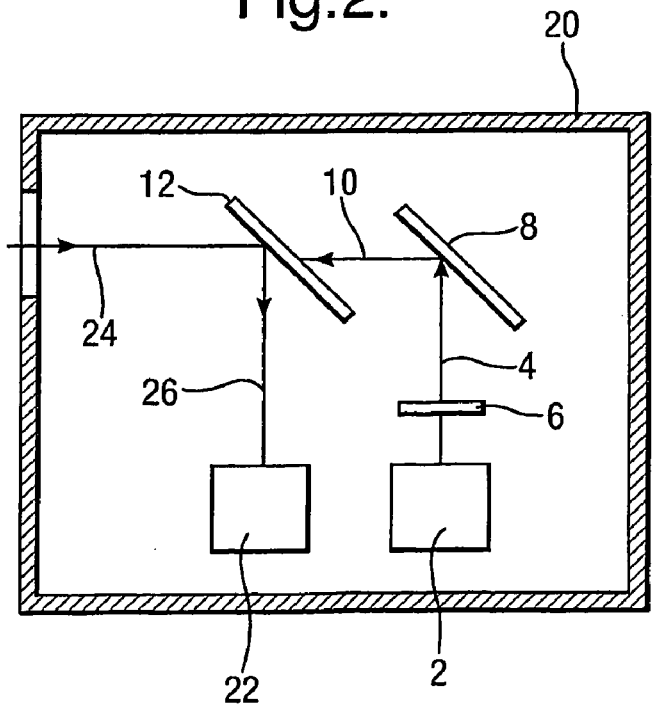
Figure 3A:
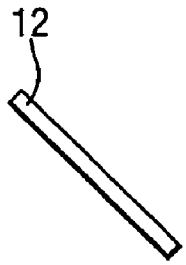
Figure 3B:
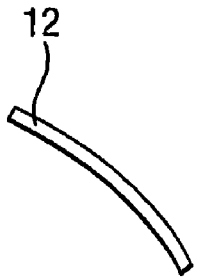
Figure 3C:
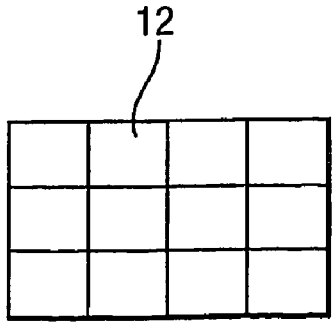
Figure 4:
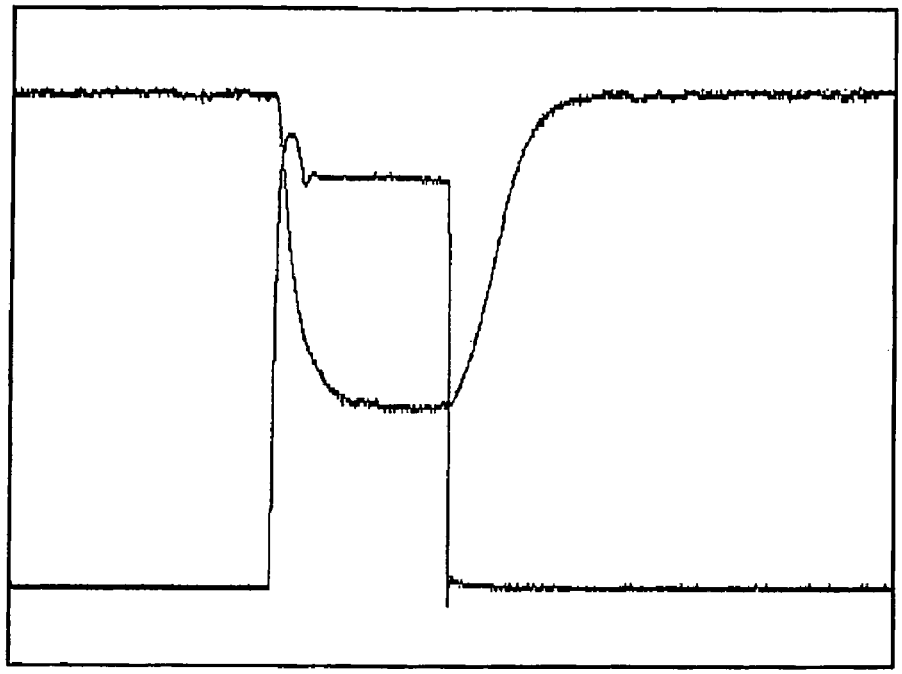

FIGS. 3*a* to 3*c* illustrate several configurations of a microwave mirror wafer utilized in FIGS. 1 and 2;

FIG. 4 is an experimental curve of a tested antenna, and

Figure 5:
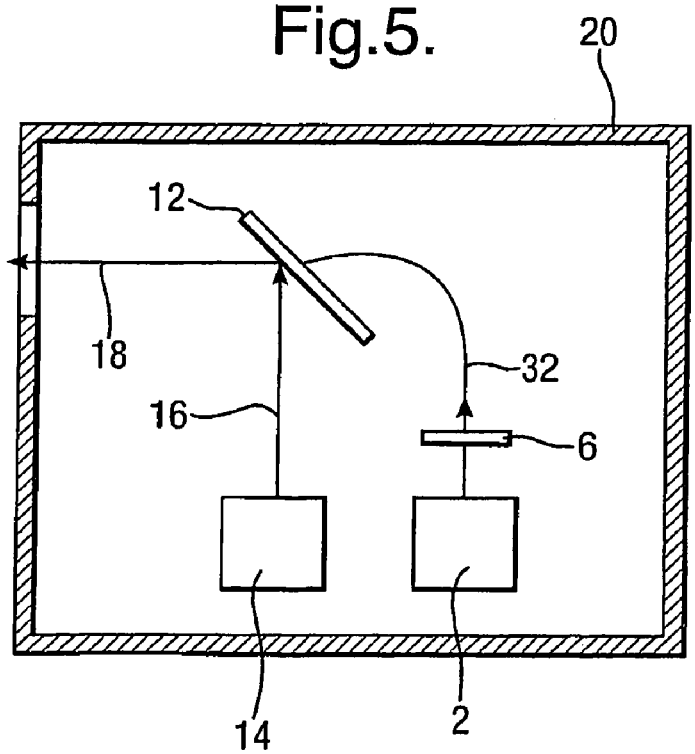

FIG. 5 is another embodiment of the antenna of FIG. 1.

DETAILED DESCRIPTION OF PREFERRED EMBODIMENTS

There is shown in FIG. 1 a schematic, cross-sectional view of a geometrically reconfigurable, optically driven, plasma antenna that can be turned off when inactive. A laser or diode light source 2 emits an optical light beam 4, shaped spatially by a spatial light filter 6 that can be one of many kinds of reconfigurable spatial filters, e.g., a liquid crystal, and directs it onto an optical mirror 8. Mirror 8 is, e.g., a dielectric coated glass substrate that does not reflect microwaves. By means of mirror 8 the optical light beam 10 is reflected on e.g., the backside of a microwave mirror wafer 12. This wafer 12 is a passive semiconductor wafer, made of e.g., doped Silicon, Germanium or Gallium Arsenide, serving as a microwave reflector or mirror when illuminated by beam 10 creating dense electron hole concentration, or plasma, inside the wafer, e.g. $10^{18}$ charges/cubic cm for a 3 cm Wavelength microwave beam. When operating in transmitting mode, the microwave mirror wafer 12 deflects a microwave beam 16 emerging from microwave source 14, into direction 18. When not illuminated, microwave mirror wafer 12 is transparent to microwaves, and electrically invisible, reducing its scattering or reflecting signature and eliminating its coupling and interference with other nearby antennas. All the metallic components, light source, spatial filter, microwave source and electronics driving it are packed and shielded in a microwave absorbing enclosure 20, having a window for microwave transmission, being electrically invisible.

In FIG. 2, there is shown a schematic, cross-sectional view of a geometrically reconfigurable, optically driven, plasma antenna in a receiving mode, that can be turned off when inactive. The operation is similar to the operation described with respect to FIG. 1 but here a microwave sensor 22 replaces the microwave source 14, and the radiation incoming into the enclosure 20 is in direction 24, and deflected by the microwave mirror wafer 12 on path 26 into the microwave sensor 22. When not illuminated, microwave mirror wafer 12 is transparent to microwaves, and electrically invisible, reducing its scattering or reflecting signature and eliminating its coupling and interference with other nearby antennas. All the metallic components, light source, spatial filter, microwave source and electronics driving it are packed and shielded in a microwave absorbing enclosure 20, having a window for microwave transmission, being electrically invisible, reducing its scattering or reflecting signature.

FIGS. 3*a* to 3*c* illustrate possible shapes of the microwave mirror wafer 12, showing at a) a flat geometry, at b) a curved wafer of any curvature and a multi-faceted mirror wafer 12 at c), having any desired number of facets, e.g., square, round or hexagonal shaped facets.

FIG. 4 is a experimental curve of a tested antenna, comprising a doped silicon wafer (having a diameter of 15 cm) operated in accordance with FIG. 1. When impinged upon by a multi-light emitting diode source (about 850 nm wavelength, peak power of 200 watt) in a pulsed mode, the upper curve is the RF 3 cm wavelength reflection and the lower curve is the light pulse. This curve shows the reflection when light is on and transparency, or no reflection, when light is off.

Referring to FIG. 5, there is shown a schematic, cross-sectional view of a geometrically reconfigurable, optically driven, plasma, or electron hole concentration, antenna that can be turned off when inactive, in its transmitting mode. The operation is similar to the operation described in FIG. 1, but here the light transmission is through a set of optical fibers or waveguides 32.

Optical fibers or lightguides can just as well be used in the arrangement of FIG. 2.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes, which come within the meaning and range of equivalency of the claims, are therefore intended to be embraced therein.

What is claimed is:

1. An optically driven, transmitting and receiving antenna-mirror, transformable into an electrically invisible antenna-mirror, when inactive, comprising:

a light source for producing a light beam;

at least one semiconductor mirror-wafer, illuminatable by said light beam;

a microwave source or a microwave sensor;

a microwave absorbing enclosure, enclosing said light source and said microwave source, having a window for microwave transmission therethrough;

said wafer having a surface for forming optically induced plasma or electron hole concentration, assuming a spatial and temporal pattern defined by a light beam impinging thereon;

wherein, upon said wafer being exposed to the light beam having a power level sufficient for creating a dense plasma or electron hole concentration in said wafer, said wafer becomes reflective to microwaves, and returns to transparency when light from said light source is turned off.

2. The optically driven, plasma or electron hole concentration antenna as claimed in claim 1, further comprising at least one optical dielectric reflecting surface, on a substrate transparent to microwave, for directing light from the light source to said wafer.

3. The optically driven, plasma or electron hole concentration antenna as claimed in claim 1, further comprising at least one spatial filter for shaping the optical beam transmitting from said light source.

4. The optically driven, plasma or electron hole concentration antenna as claimed in claim 1, wherein said light source is a laser or an array of light emitting diodes.

5. The optically driven, plasma or electron hole concentration antenna as claimed in claim 1, wherein light from said light source is transmitted through a lightguide or optical fibers.

6. The optically driven, plasma or electron hole concentration antenna as claimed in claim 1, wherein said wafer is a passive semiconductor wafer, selected from the group of materials including doped Silicon, Germanium or Gallium Arsenide.

* * * * *